US005687664A

United States Patent [19]

Sofian

[11] Patent Number: 5,687,664

[45] Date of Patent: Nov. 18, 1997

[54] FOLDABLE INFLATABLE RESCUE PONTOON

[76] Inventor: Terry N. Sofian, 352 Misty Valley Dr., St. Peters, Mo. 63376

[21] Appl. No.: 630,370

[22] Filed: Apr. 10, 1996

[51] Int. Cl.[6] ..... B63B 1/00

[52] U.S. Cl. ..... 114/61; 114/345; 114/354; 114/292; 441/80

[58] Field of Search ..... 441/80, 82, 83, 441/84, 88, 35, 40, 41, 42, 129, 130, 131, 132; 114/345, 61, 354, 292

[56] References Cited

U.S. PATENT DOCUMENTS

| | | | |
|---|---|---|---|
| D. 322,301 | 12/1991 | Harris | D12/237 |
| 2,403,436 | 7/1946 | Heigis | 114/345 |
| 3,370,310 | 2/1968 | La Tour | 441/80 |
| 3,992,739 | 11/1976 | Stevens et al. | 9/14 |
| 4,058,862 | 11/1977 | Stevens et al. | 9/14 |
| 4,520,746 | 6/1985 | Walters et al. | 114/123 |
| 4,736,474 | 4/1988 | Moran et al. | 5/82 R |
| 4,747,797 | 5/1988 | Hindle | 441/38 |
| 5,374,211 | 12/1994 | Imazato | 441/80 |
| 5,421,757 | 6/1995 | Basiliere | 441/80 |

OTHER PUBLICATIONS

Jack's Plastic Welding, Aztec, NM; "Adventure Imagineering" Advertising Brochure; (admitted prior art).

*Primary Examiner*—Stephen Avila

*Attorney, Agent, or Firm*—Senniger, Powers, Leavitt & Roedel

[57] ABSTRACT

An inflatable rescue pontoon for performing multiple water rescue operations comprises an elongate shell having a plurality of longitudinally extending individual sections. The plurality of individual sections includes a bow section. The bow section is the forwardmost individual section and is hydrodynamically shaped to enhance maneuverability of the pontoon in water. Valve means communicate with the shell for selectively inflating and deflating the pontoon.

24 Claims, 6 Drawing Sheets

FOLDABLE INFLATABLE RESCUE PONTOON

BACKGROUND OF THE INVENTION

The present invention generally relates to floating aquatic devices and more particularly pertains to an inflatable pontoon which is useful in rescue and other emergency operations.

Water rescue of a victim who is injured, trapped or in danger of drowning often requires the rescuer to put himself in similar danger. The danger is even greater in situations involving turbulent water such as rapid flowing currents of a river or large tides of a lake or ocean. To this end, it is known to provide floatation devices which may be used by a rescuer to reach the victim from a remote position. Rescue from a remote location often allows the rescuer to reach the victim more quickly and involves less risk of harm to the rescuer. Commonly known such devices include ring-shaped life preservers having a rope attached so that the rescuer may toss the life preserver to the victim and pull the victim to safety. One difficulty in using a life preserver for rescue is guiding the life preserver to the victim. If the initial throw of the life preserver does not place it sufficiently close to the victim, the rescuer must pull the life preserver in and make further throws, resulting in lost time and effort. Storage and transportation of bulky floatation devices is another common problem since the rescuer often must carry several pieces of equipment to the rescue site.

To solve these problems, it is known to provide an inflatable floatation device which can be guided by the rescuer from a remote position to reach a victim, and which also may be deflated and folded or rolled into a compact configuration for storage and transport. For example, the device disclosed in U.S. Pat. No. 4,058,862 (Stevens) includes multiple elongate inflatable bladders within a soft material shell surrounding the bladders. The bladders are all in fluid communication with each other so that inflating air entering one bladder flows into the other bladders to inflate the bladders. Grab lines surround the device so that a victim can hold onto the lines and be pulled to safety. Once inflated, the device is held by a rescuer standing on stable ground and then extended into the water where it can be guided by the rescuer to a remote victim.

One disadvantage of this device is that it must be sufficiently long to reach the victim, or a number of devices must be strung together in order to reach the victim. This can be costly and difficult to maintain in operation. Furthermore, because the device extends from the rescuer all the way to the victim, the device is exposed to a large surface area of water. Where rescuing a victim in a river with rapid flowing currents, the entire floatation device would be perpendicular to the flowing current. The flow of the current would thus push strongly against the side of the device and prevent the device from being maneuvered to the victim. In addition, because the protective shell is made from soft material, the device is susceptible to damage, such as puncturing or tearing, from foreign objects flowing in the current which may impact against the device. Still another disadvantage is that because the bladders are in open communication with one another, if one bladder is punctured and deflates, all of the bladders will deflate, rendering the device inoperable.

There is a need, therefore, for a foldable inflatable rescue device capable of being maneuvered to a victim in rapid flowing currents or tides by a rescuer from a remote position, which is resistant to damage caused by objects impacting against the device, which can sustain damage to one inflation bladder and remain operational, which can be deflated and folded into a compact configuration for storage and transport and which can perform multiple functions to reduce the amount of equipment required to be carried by the rescuer.

SUMMARY OF THE INVENTION

Among the several objects and features of this invention may be noted the provision of an improved foldable inflatable floatation device for remote rescue of a victim in water; the provision of such a device which is highly maneuverable from a remote position to a victim in rapid flowing or turbulent water such as found in rivers, lakes and oceans; the provision of such a device which is resistant to damage caused by foreign objects floating in the rapid flowing or turbulent water impacting the device; the provision of such a device which is capable of sustaining a puncture to one inflated bladder and remaining operable; the provision of such a device which can be deflated and folded into a compact configuration for storage and transport; the provision of such a device which is lightweight; the provision of such a device which may be used for various rescue operations, both aquatic and non-aquatic; the provision of such a device which is inexpensive to manufacture and easy to use.

In general, an inflatable rescue pontoon of this invention for performing multiple water rescue operations comprises an elongate shell having a plurality of sections including a bow section. The sections are longitudinally aligned when the pontoon is inflated. The bow section is the forwardmost section and is hydrodynamically shaped to enhance maneuverability of the pontoon in water. Valve means communicate with the shell for selectively inflating and deflating the pontoon.

Another embodiment of the inflatable rescue pontoon of this invention for performing multiple rescue operations comprises an elongate shell. The shell has load distributing means along at least a portion of the shell such that loads bearing on the load distributing means are distributed along at least a portion of the shell.

Other objects and features will be in part apparent and in part pointed out hereinafter.

BRIEF DESCRIPTION OF THE DRAWINGS

Corresponding parts are indicated by corresponding reference numerals throughout the several views of the drawings.

DESCRIPTION OF PREFERRED EMBODIMENT

Figure 1:
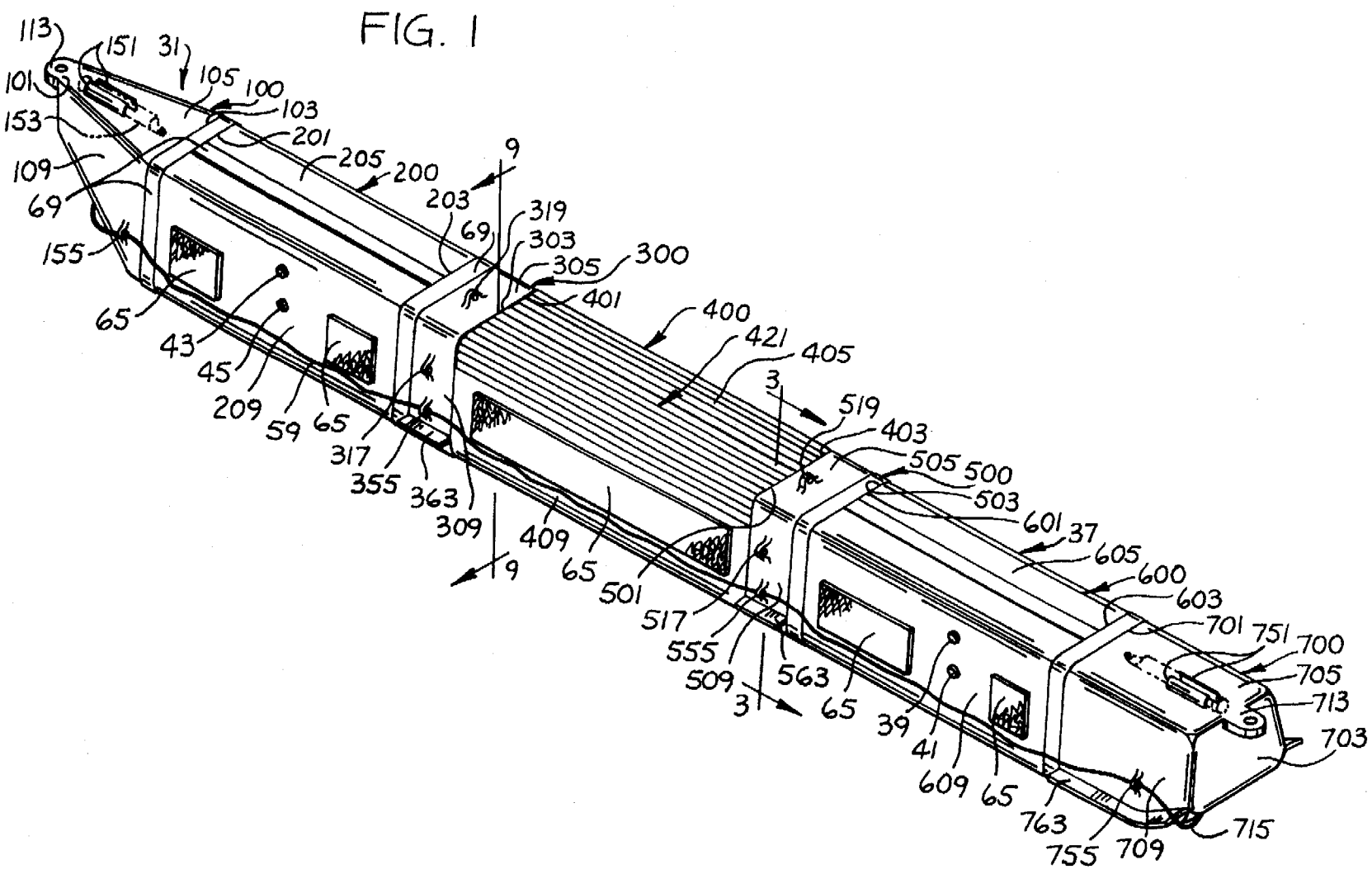
FIG. 1 is a perspective view of the folding inflatable rescue pontoon comprising the present invention.

With reference now to the drawings, and in particular to FIGS. 1–4 thereof, a new foldable inflatable rescue pontoon embodying the principles and concepts of the present invention and generally designated by the reference numeral 31 will be described.

Figure 3:
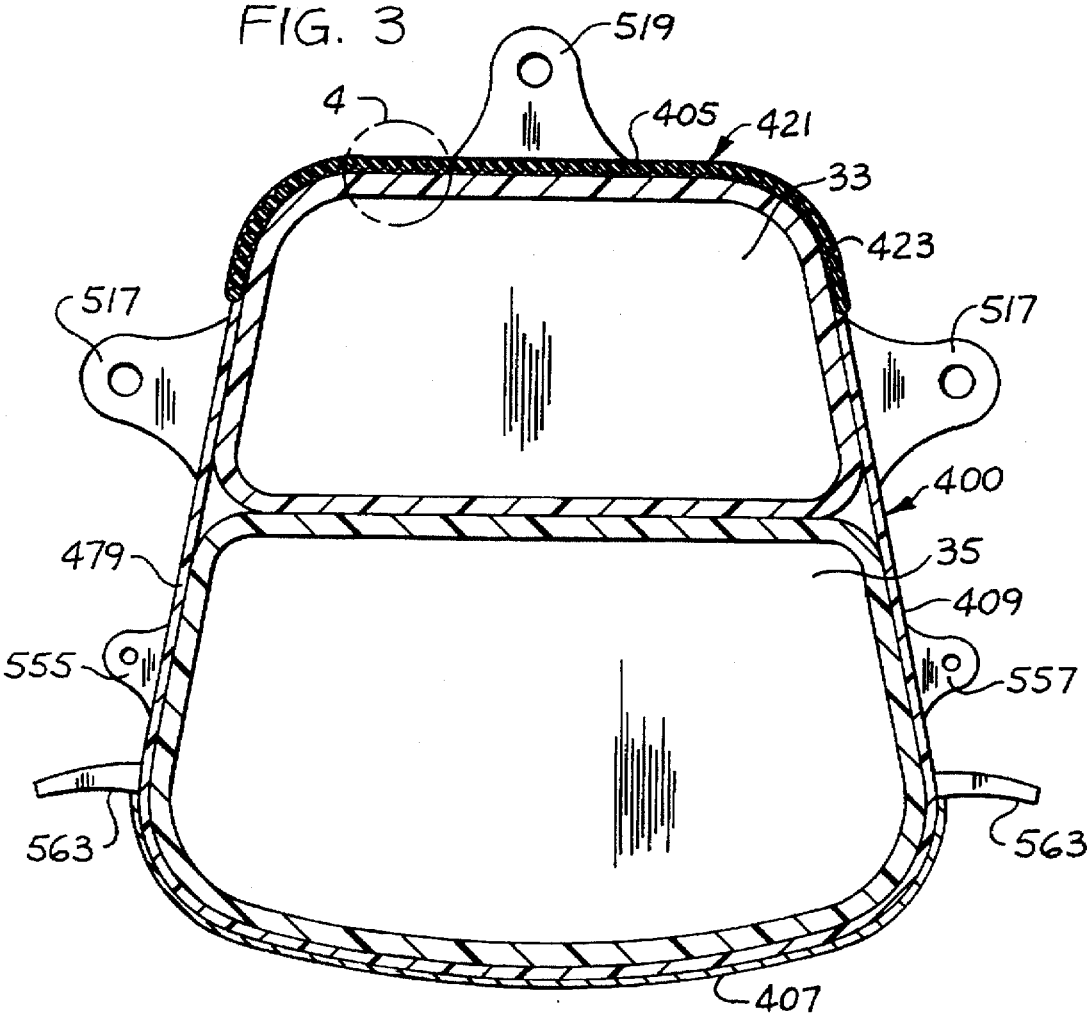
FIG. 3 is a cross-sectional view of the invention as viewed along the line 3—3 in FIG. 1.

More specifically, it will be noted in FIG. 3 that the rescue pontoon 31 includes an upper bladder 33 and a lower bladder 35 contained within a shell (indicated generally at 37). The bladders 33, 35 are formed of material which will not be harmed by immersion in water for prolonged periods of time. This material is preferably abrasion resistant to resist damage caused by abrading against rough surfaces such as a rock bed or ice. Thus, even if the shell were broken or torn to expose the bladders 33, 35, the bladders themselves would be resistant to damage. The bladders 33, 35 are entirely independent from one another and have no fluid communication between them. Since the bladders 33, 35 are entirely independent from one another, even if one bladder inadvertently deflates, the rescue pontoon 31 is still capable of floating using only the remaining inflated bladder. It is noted, however, that any number of airtight bladders, including one bladder, is contemplated to be within the scope of this invention. The bladders 33, 35 are inflated during a rescue operation and deflated for transport and storage of the pontoon 31. Preferably, the bladders 33, 35 are oriented one on top of the other extending longitudinally within the shell 37 in a parallel relationship. The lower bladder 35 is greater in width than the upper bladder 33, such that a cross-section of the pontoon 31 is roughly trapezoidal in order to add rolling stability to the pontoon. However, the bladders 33, 35 contained within the shell 37 may lie in any relationship relative to one another, such as a side-by-side relationship, and may be of any relative width and remain within the scope of this invention.

Connected to each bladder 33, 35 is a one-way air inlet valve 39, 41 for allowing inflating air to enter into the bladder, and an automatic pressure relief valve 43, 45 for discharging air from the bladder and preventing damage caused by overinflation. The air inlet valves 39, 41 each include a quick release fitting (not shown) to allow air lines connected to the source of inflating air (not shown) to be attached and removed rapidly. The pressure relief valves 43, 45 may be fitted with a cover (not shown) that will prevent them from functioning when a higher inflation pressure is desired for particular rescue operations. These covers are preferably brightly colored for higher visibility so that a rescuer is alerted when the covers are in place. The air inlet valves 39, 41 and pressure relief valves 43,45 are preferably constructed of brass or other non-ferrous metals to prevent corrosion.

The shell 37 surrounds the airtight bladders 33, 35 so that the bladders are enclosed within the shell. As best seen in FIG. 1, the shell 37 is defined by several interconnected longitudinally extending sections, including, in order from front to rear, a bow section, a forward folding section, a forward load bearing section, a load distributing section, a rear load bearing section, a rear folding section and a stern section (indicated generally at 100, 200, 300, 400, 500, 600 and 700 respectively). The sections 100–700 include various materials to prevent puncture, abrasion or other damage while maintaining sufficient flexibility to allow for folding of the pontoon 31 for transport or storage. The sections 100–700 are interconnected to form the single rescue pontoon shell 37. It is also contemplated to be within the scope of this invention that the materials of the shell 37 may be such that the shell itself is airtight and inflatable, eliminating the need for the airtight inflatable bladders 33, 35 enclosed within the shell. All materials used in the construction of the pontoon 31 should be resistant to corrosion and mildew, and the shell 37 should preferably be brightly colored. Red, white, international orange and "day glow" colors would provide maximum daylight visibility against water that might be dark brown or blue.

The bow section 100 is the forwardmost individual section of the shell 37, and is hydrodynamically shaped to assist the rescue pontoon 31 in maintaining a favorable orientation relative to the flowing current or tides and to enhance the maneuverability of the pontoon through the flowing current or tides. The bow section 100 of the shell 37 has a front 101, rear 103, top wall 105, bottom wall 107, and side walls 109, 111. The distance between the side walls 109, 111 is substantially narrower near the front 101 of the bow section 100 than near the rear 103 of the bow section such that the side walls extend longitudinally from the front of the bow section to the rear of the bow section in a generally V-shaped configuration. The top wall 105 of the bow section 100 is generally horizontal, while the bottom wall 107 of the bow section 37 slopes upward from the rear 103 of the bow section to the front 101 of the bow section.

Figure 10:
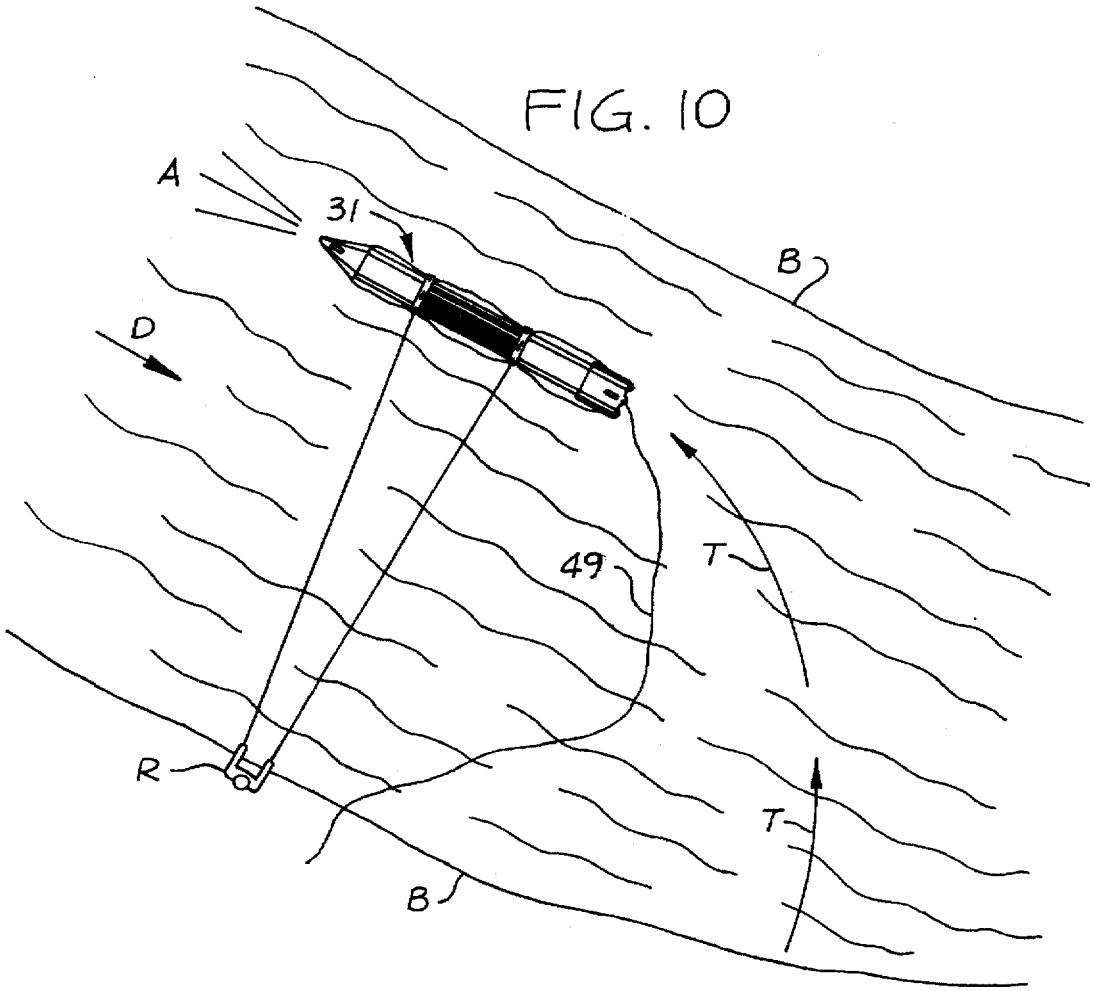
FIG. 10 is a top view of the rescue pontoon of the invention being used in a line crossing operation.

This arrangement creates a hydrodynamic shape which, as shown in FIG. 10, allows the rescue pontoon 31 to be maneuvered through a flowing current by a rescuer R remotely located from the pontoon, such as standing on the bank B of a river. Control lines 47 are connected to the pontoon 31 and held by the rescuer R. A life line 49, used for particular rescue purposes, may also be attached to the pontoon 31. As the pontoon 31 extends into the flowing current, the angle of attack A of the pontoon is controlled by the rescuer R using the control lines 47. Because of the hydronamic shape of the pontoon, the rescuer R can maneuver the pontoon 31 into various angles of attack A using the control lines 47. By maneuvering the pontoon 31 into particular angles of attack A, the hydronamic shape of the pontoon allows the pontoon to move forward against the direction D of the flowing current, for example, along track T.

Figure 6:
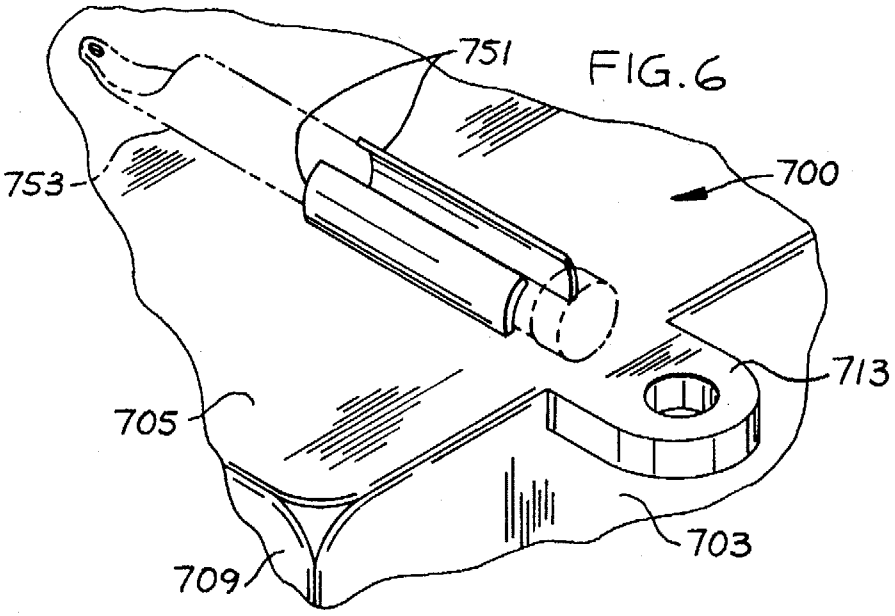
FIG. 6 is an enlarged detail view of a lighted stick holder utilizable on the invention.

Referring again to FIG. 1, a pair of protrusions 151 extend upward from the top wall 105 of the bow section 100 and are angled slightly inward toward one another. The protrusions 151 may be either molded or attached to the top wall 105 of the bow section 100. The protrusions 151 are elastic so they function as a clip to hold various rescue accessories. Particularly, a battery powered light stick (not shown) or CYALUM stick 153 as shown in close-up in FIG. 6, may be releasably held between the two protrusions 151 during use of the rescue pontoon 31. A number of fittings are either integrally molded or attached to the bow section of the shell. An attachment fitting 113 extends forward from the front 101 of the bow section 100 and has adequate strength to be used for holding lifelines. Grab line fittings 155, 157 of lesser strength extend from the side walls 109, 111 of the bow section 100 for the attachment of oppositely disposed respective grab lines 59, 61. The bow section 100 of the shell 37 is molded from a flexible, high-impact resistant material, preferably plastic, to provide protection against damage caused by foreign objects flowing in the current or tides. The plastic material is sufficiently flexible and resilient such that when the rescue pontoon 31 is folded and collapsed for transport, the width of the bow section 100 may also be collapsed to further compact the folded pontoon.

The stern section 700 is the rearwardmost individual section of the shell 37 and operates to provide stability and strength. The stern section 700 is shaped to assist the rescue pontoon 31 in maintaining a favorable orientation relative to the flowing current or tides and to enhance the maneuverability of the pontoon through the flowing current or tides. As may be seen in FIGS. 1 and 3, the stern section 700 of the shell 37 includes a front 701, rear wall 703, top wall 705, bottom wall 707, and side walls 709, 711. The side walls 709, 711 and top wall 705 are generally rectangular in shape. The top wall 705 and bottom wall 707 are generally parallel, with the exception of a rear portion 715 of the bottom wall which slopes upward as it approaches the rear wall 703. The side walls 709, 711 slope outward from the top wall 705 to the bottom wall 707 such that a cross-section of the stern is generally trapezoidal. The rear wall 703 extends vertically between the top wall 705 and bottom wall 707, such that the top wall, bottom wall, rear wall and side walls 709, 711 are arranged to form a transom configuration. Those skilled in the art will recognize that the transom configuration will operate to reduce drag on the rescue pontoon 31 as the pontoon maneuvers through the flowing current or tides.

A pair of protrusions 751 extend upward from the top wall 705 of the stern section 700 and are angled slightly inward toward one another. The protrusions 751 are substantially identical to the protrusions 151 on the bow section 100, and may be either molded or attached to the top wall 705 of the stern section 700. Various rescue accessories, particularly a battery powered light stick (not shown) or CYALUM stick 753 may be releasably held between the protrusions 751 during use of the rescue pontoon 31. A number of fittings are either integrally molded or attached to the bow section. An attachment fitting 713 extends rearward from the rear wall 703 of the stern section 700 and has adequate strength for holding lifelines, Grab line fittings 755 of lesser strength extend outward from the side walls 709, 711 of the stern section 700, for the attachment of oppositely disposed respective grab lines 59, 61. The stern section 700 of the shell 37 is molded from a flexible, high-impact resistant plastic similar to the bow section 100 of the shell. The plastic material is sufficiently flexible and resilient such that when the rescue pontoon 31 is folded and compressed for transport, the stern section 700 may also be collapsed to further compact the folded pontoon. Stabilizer fins 763 are molded integrally with the side walls 709, 711 of the stern section 700 for additional stability in keeping the rescue pontoon 31 in an upright floating position in rough water situations.

The folding sections of the shell, namely a forward folding section 200 and a rear folding section 600, allow the rescue pontoon 31 to be folded into a compact configuration when the bladders 33, 35 are deflated for transport or storage of the pontoon. The folding sections 200, 600 of the shell 37 are preferably made of a multi-ply flexible, abrasion resistant material. The preferred material is commonly available under the trademarks CORDURA and BALLISTIC NYLON. The folding sections 200, 600 of the shell 37 surround the exterior of the bladders 33, 35 in close contact with the bladders to form a generally trapezoidal cross-section. Each folding section 200, 600 has a front 201, 601, rear 203, 603, top wall 205, 605, bottom wall 207, 607 and side walls 209, 211, 609, 611, respectively. The bottom wall 207, 607 of each folding section 200, 600 preferably has an additional layer of a heavy material capable of resisting punctures and tearing. Sail cloth or other heavy materials having similar properties are contemplated as being within the scope of the invention. Each folding section 200, 600 has large patches of VELCRO 65 attached to the side walls 209, 211, 609, 611 to facilitate the attachment of specialized equipment. Strips of reflective material 69 are applied to the top wall 205, 605 and side walls 209, 211, 609, 611 to ensure high visibility.

The forward folding section 200 of the shell 37 is located immediately behind the bow section 100 of the shell and the front 201 of the forward folding section is connected to the rear 103 of the bow section. The forward folding section 200 of the shell 37 has a pair of openings (not shown) therein through which the pressure relief valves 43, 45 connected to the inflatable bladders 33, 35 extend to allow access to the pressure relief valves. The rear folding section 600 of the shell 37 is located immediately forward of the stern section 700 of the shell and the rear 603 of the rear folding section is connected to the front 701 of the stern section. The rear folding section 600 of the shell 37 has a pair of openings (not shown) therein through which the one-way inflation valves 39, 41 connected to the inflatable bladders 33, 35 extend to allow access to the inflation valves.

A forward load bearing section 300 of the shell 37 is located immediately behind the forward folding section 200 of the shell 37 and a front 301 of the forward load bearing section is connected to the rear 203 of the forward folding section. A rear load bearing section 500 of the shell 37 is located immediately forward of the rear folding section 600 of the shell and a rear 503 of the rear load bearing section is connected to the front 601 of the rear folding section. Each of the load bearing sections 300, 500 of the shell 37 is formed of a flexible, high-impact molded material similar to the bow section 100 of the shell, and is designed to provide a load bearing area for lifelines and other attachments, as well as for loads carried by a load distributing section 400. Each load bearing section 300, 500 of the shell 37 also includes a front 301, 501, rear 303, 503, top wall 305, 505, bottom wall 307, 507 and side walls 309, 311, 509, 511, arranged to form a generally trapezoidal cross-section configuration. A number of fittings are either integrally molded or attached to each load bearing section. A control line fitting 317, 517 extends from the side walls 309, 311, 509, 511 of each load bearing section 300, 500 and has adequate strength for holding control lines 47. Grab line fittings 355, 357, 555, 557 extending from the side walls 309, 311, 509, 511 of each load bearing section 300, 500, being of lesser strength, are used for the attachment of oppositely disposed respective grab lines 59, 61. An attachment fitting 319, 519 extends upward from the top wall 305, 505 of each load bearing section 300, 500 and has adequate strength to be used for holding lifelines or for attaching various accessories thereto, such as the collapsible ladder 67 shown in FIG. 8. Stabilizer fins 363, 563 are molded integrally with the side walls 309, 311, 509, 511 of each load bearing section 300, 500 of the shell 37 for additional stability in keeping the rescue pontoon 31 in an upright floating position in rough water situations.

The load distributing section 400 is located between the forward and rear load bearing sections 300, 500 of the shell 37 at the center of the shell. A front 401 of the load distributing section 400 is connected to the rear 303 of the forward load bearing section 300 and a rear 403 of the load distributing section is connected to the front 501 of the rear load bearing section 500. The load distributing section 400 of the shell preferably is made of a multi-ply, flexible, abrasion resistant material similar to the material of the folding sections 200, 600. The material of the load distributing section 400 of the shell 37 surrounds the exterior of the inflatable bladders 33, 35 in close contact with the bladders such that the load distributing section has a generally trapezoidal cross-section. The load distributing section 400 further has a top wall 405, bottom wall 407 and side walls 409, 411. The bottom wall 407 of the load distributing section 400 preferably has an additional layer of a heavy material capable of resisting punctures and tearing. Sail cloth or other heavy materials having similar properties are contemplated as being within the scope of the invention.

Figure 4:
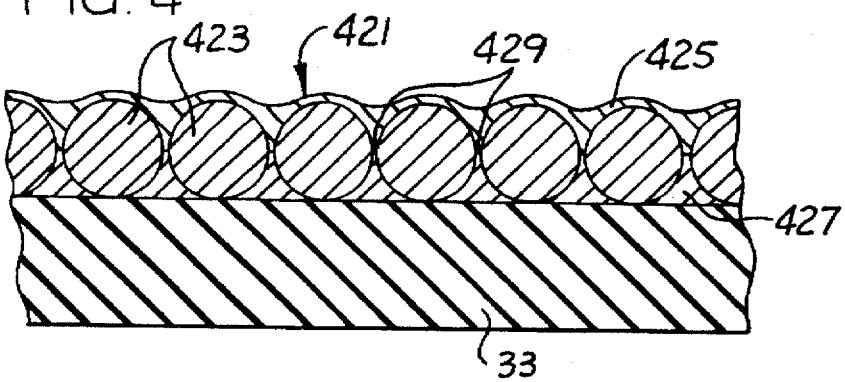
FIG. 4 is an enlarged detail view of the invention as taken from FIG. 3 of the drawings.

Load distributing means, indicated generally as 421, extend longitudinally along the top wall 405 and a portion of each side wall 409, 411 of the load distributing section 400 between the load bearing sections 300, 500 to reinforce the top wall of the load distributing section of the shell 37. This allows greater loads, such as the weight of a rescue victim or heavy equipment, to be carried by the load distributing section 400 and distributed to the more rigid load bearing sections 300, 500. The load distributing means 421 is supported by the load bearing sections 300, 500 in a manner which allows loads to be transferred from the load distributing means to the load bearing sections so that loads supported by the load distributing means are distributed to the load bearing sections. As shown in FIGS. 3 and 4, the preferred load distributing means 421 comprises a set of longitudinally extending reinforcing rods 423 held between two plys 425, 427 of the flexible, abrasion resistant material of the load distributing section 400. Longitudinally extending webs 429 of the same material connect the two plys 425, 427 to define individual pockets extending longitudinally within the top wall 405 of the load distributing section 400 of the shell 37. A reinforcing rod 423 extends through each pocket and the rods are thus held in side-by-side relationship within the top wall 405 of the load distributing section 400. Using multiple rods 423 in a side-by-side relationship allows the load distributing section 400 to be more fully collapsed during transport of the pontoon 31 since no deformation of the rods is necessary. It is noted that the rods 423 may be held in side-by-side relationship by other conventional methods such as flexible wire extending laterally through each rod and still remain within the scope of this invention. The load distributing means 421 may also be a single piece construction of flexible, resilient material, such as flexible, high-impact resistant plastic similar to that of the bow section 100, and remain within the scope of this invention.

Figure 9:
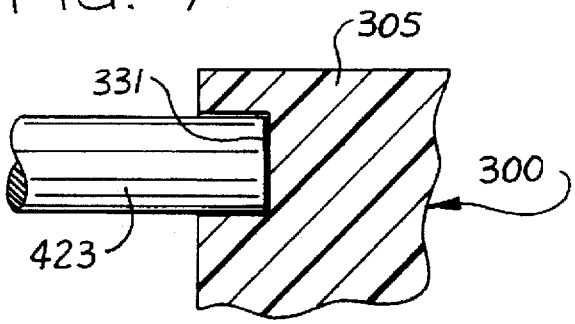
FIG. 9 is an enlarged fragmentary schematic section taken in the plane including line 9—9 in FIG. 1 and showing reception of a load distributing rod in a load bearing member.

The top wall 305, 505 and portions of the side walls 309, 311, 509, 511 of each load bearing section 300, 500 of the shell 37 has sockets 331 spaced laterally therein such that each reinforcing rod 423 seats in a corresponding socket in the load bearing section. FIG. 9 illustrates one of the reinforcing rods 423 extending into a socket 331 within the forward load bearing section 300. When a load is placed on the load distributing means 421, the ends of the reinforcing rods 423 bear on the high-impact material of the load bearing sections 300, 500 such that some of the load is transferred to the load bearing sections. The load supported by the pontoon 31 is thus more evenly distributed, which reduces possible instability of the pontoon caused by excessive loading. Seating the rods 423 in individual sockets 331 within the top wall 305, 505 and side walls 309, 311, 509, 511 of each load bearing section 300, 500 has the additional advantage of allowing loads bearing directly on the load bearing sections to be transmitted to and distributed by the reinforcing rods over the load distributing section 400. Alternatively, the rods 423 may rest on top of the top wall of the load bearing sections of the shell and still remain within the scope of this invention, as long as the rods contact the load bearing sections in a manner which allows loads to be transmitted from the rods to the load bearing sections of the shell. It is also contemplated that the reinforcing rods 423 may be of any cross-sectional shape and may be of any water resistant material, such as treated wood, plastic or other lightweight material, and remain within the scope of this invention. Wide bands of VELCRO 65 are attached to the side walls 409, 411 of the load distributing section 400 to facilitate the attachment of specialized equipment.

Figure 5:
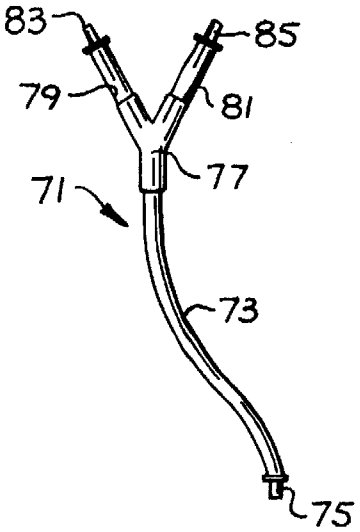
FIG. 5 is an isometric view of an inflation tube for use with the present invention.

FIG. 5 of the drawings illustrates an inflation tube, indicated generally at 71, which can be used with the rescue pontoon 31 of the present invention. In this respect, the inflation tube 71 comprises a flexible inlet conduit 73 which has a quick connector 75 attachable to an air tank (not shown) filled with compressed air, such as a Self Contained Breathing Apparatus (SCBA) tank or a Self Contained Underwater Breathing Apparatus (SCUBA) tank, with the opposing end of the inflation tube having a Y-joint 77. A pair of flexible outlet conduits 79, 81 extend outwardly from the Y-joint 77 and are provided with respective quick connect valves 83, 85. With the quick connector 75 of the inlet conduit 73 attached to the air tank (not shown) filled with compressed air, and the quick connect valves 83, 85 of the outlet conduits 79, 81 attached to the air inlet valves 39, 41 of the bladders 33, 35, means are provided for quickly inflating the rescue pontoon 31 in a now apparent manner.

Figure 8:
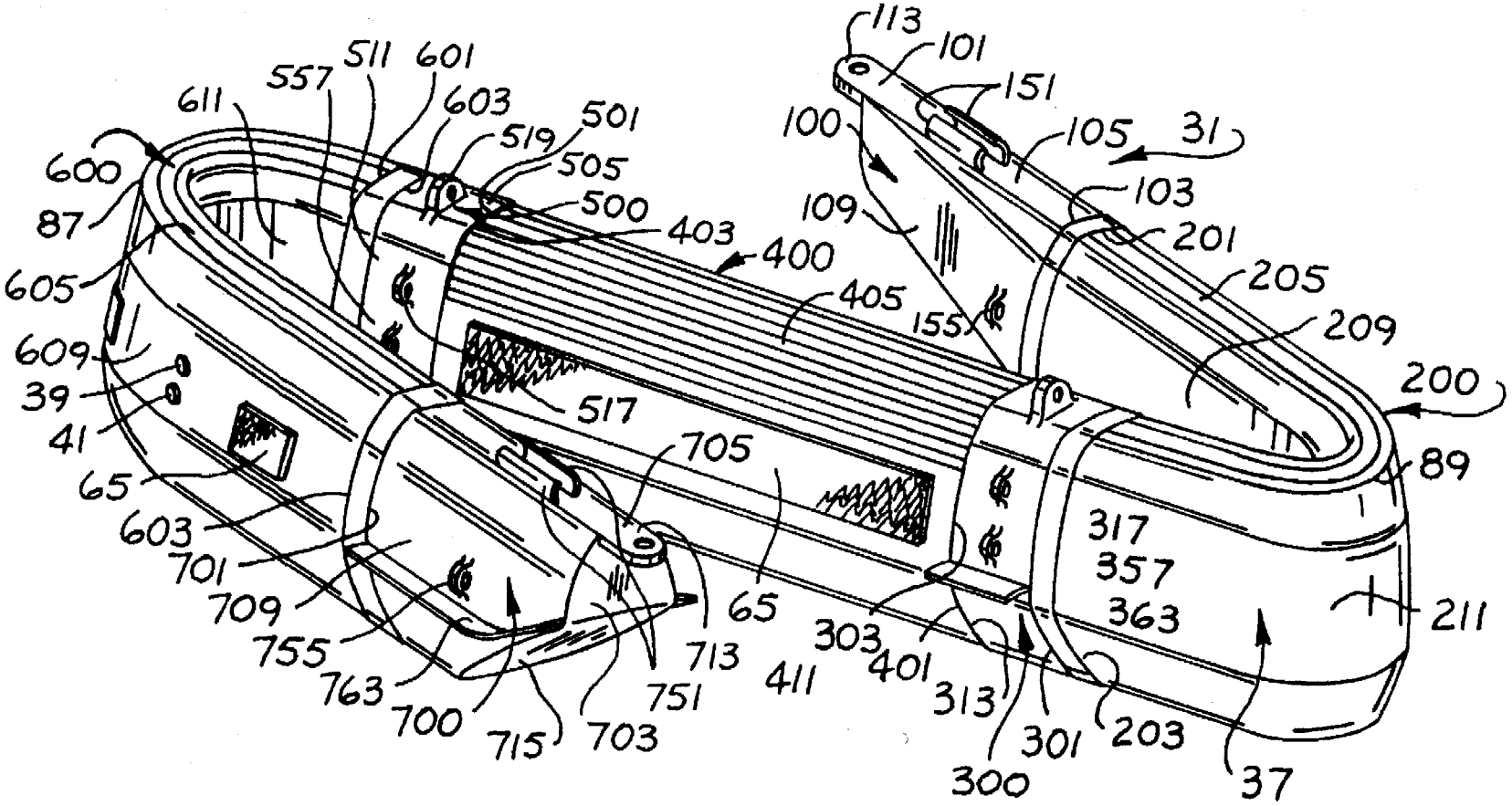
FIG. 8 is a perspective view of the invention in a partially folded configuration.

FIG. 8 shows the rescue pontoon 31 of this invention in a partially folded configuration. When the pontoon 31 is to be folded for transport or storage, the bladders 33, 35 are deflated. The rear folding section 600 of the shell 37, along with the stern section 700, is folded forward at a location 89 proximate the front 601 of the rear folding section 600. The rear folding section 600 is folded in a direction opposite the air inlet valves 39, 41 such that the air inlet valves are easily accessible when the rescue pontoon 31 is folded. The forward folding section 200 of the shell 37, along with the bow section 100, is folded rearward at a location 89 proximate the rear 203 of the forward folding section. The forward folding section 200 is folded in a direction opposite the rear folding section 600 such that the bow section 100 and stern section 700 of the shell 37 are disposed on opposite sides of the load distributing section 400 of the shell. Once the pontoon 31 is in a folded configuration, it may be further compacted by compressing the flexible, high-impact material of the bow section 100, stern section 700 and load bearing sections 300, 500 of the shell 37. The flexibility allows these sections to collapse to a generally ovate shape in cross-section such that the overall profile of the pontoon in the folded position is further collapsed for storage or transport.

To deploy the pontoon 31 for use, the folded pontoon is laid on the ground with the air inlet valves 39, 41 extending from the rear folding section 600 of the shell 37 exposed. The quick connect valves 83, 85 of the inflation tube 71 are connected to the air inlet valves 39, 41 of the bladders 33, 35. The quick connector 75 of the inlet conduit 73 of the inflation tube 71 is connected to an external source (not shown) of compressed air, such as the aforementioned SCUBA bottle, which is not carried by the pontoon 31. It is contemplated, however, that a CO2 cartridge (not shown) may be carried with the pontoon 31 as a source of compressed air for rapid inflation of the pontoon to reduce deployment time. Once connected, compressed air flows into each of the bladders 33, 35 of the pontoon 31 to inflate the bladders. If a low pressure application is planned, the pressure relief valves 43, 45 extending from the forward folding section 200 of the shell 37 are activated through the removal of any covers (not shown) which may be attached thereto. If a high pressure application is planned, the pressure relief valves 43, 45 will be provided with covers that will prevent the pressure relief valves from functioning. As the bladders 33, 35 are inflated, the pontoon 31 will unfold into an operable working configuration.

As shown in FIG. 10, the pontoon 31 is particularly useful in river crossing situations. The hydrodynamic force of a current may be used to propel a pontoon 31 across a river. More particularly, by attaching a lightweight control line 47 to one side wall 309, 509 of each load bearing section 300, 500 of the shell 37, and having a rescuer R hold the other ends of the control lines on stable ground, such as the bank B of the river, the angle of attack A of the pontoon 31 may be controlled by the rescuer in the same way that a kite can be controlled against the wind. By controlling the angle of attack A, the pontoon 31 may be guided across the river along track T, against the direction D of the flowing current, and it might be used to carry equipment or to get the pontoon within reach of a victim for a rescue. Additionally, another rope, such as a life line 49 can be attached to the attachment fitting 713 extending from the rear 703 of the stern section 700 of the shell 37, and the three lines can be moved across a river simultaneously. This will allow a line secured on both sides of a river and suspended above the water, known as a high line, to be set up quickly, and with less risk to personnel.

By attaching closed loops of rope (not shown), commonly known to those skilled in the art as prussik loops, to the top wall 305, 505 of each load bearing section 300, 500, and further connecting the loops to a high line suspended above the water by using metal rings (not shown), commonly known as carabiners, the pontoon 31 is useful in a high line rescue. Careful sizing of the prussik loops will allow the pontoon 31 to float in the water and not be suspended above it. Lifelines attached to the attachment fittings 113, 713 extending from the front 101 of the bow section 100 and from the rear 703 of the stern section 700 will allow the pontoon 31 to be moved from one side of the river to the other while being guided by the high line. Victims trapped within swirling or reverse flowing currents, commonly referred to as hydraulics, can be rescued in this manner, as can a rescue for a victim trapped on a rock or tree in midstream. It can also be used as a downstream safety device in case victims are being washed downstream.

The pontoon 31 can also be used for equipment transport. Water resistant containers carrying equipment can be held on the pontoon 31 with VELCRO straps (not shown) to allow it to be floated to where it is needed in an aquatic incident scene. Medical and extraction equipment that is heavy and bulky would be especially easy to transport on the pontoon 31.

It is also contemplated that the pontoon 31 could be used as a marker buoy. The large size, high buoyancy, bright coloration, and ability to hold lighted sticks 53 for night lighting make the pontoon 31 an excellent marker buoy for use by divers or rescue swimmers.

The pontoon 31 can also be used in trapped boater extraction situations. With the pressure relief valves 43, 45 covered, the pontoon 31 may be used to extricate a victim trapped between a boat or car and a fixed object by a current. The pontoon 31, with deflated bladders 33, 35, will be placed between the object and the vehicle and then inflated. The expansion of the pontoon 31 may allow sufficient space to be formed for victim extraction. By covering the pressure relief valves 43, 45, the pontoon 31 is also useful as a salvage device to recover or stabilize sunken objects by attaching a deflated pontoon to the sunken object and then inflating the pontoon.

Figure 2:
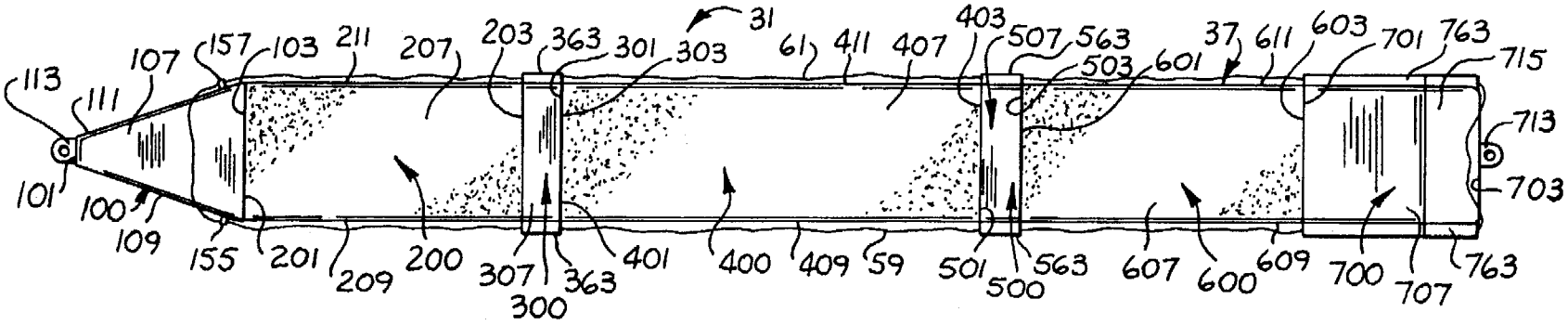
FIG. 2 is a bottom plan view thereof.
Figure 7:
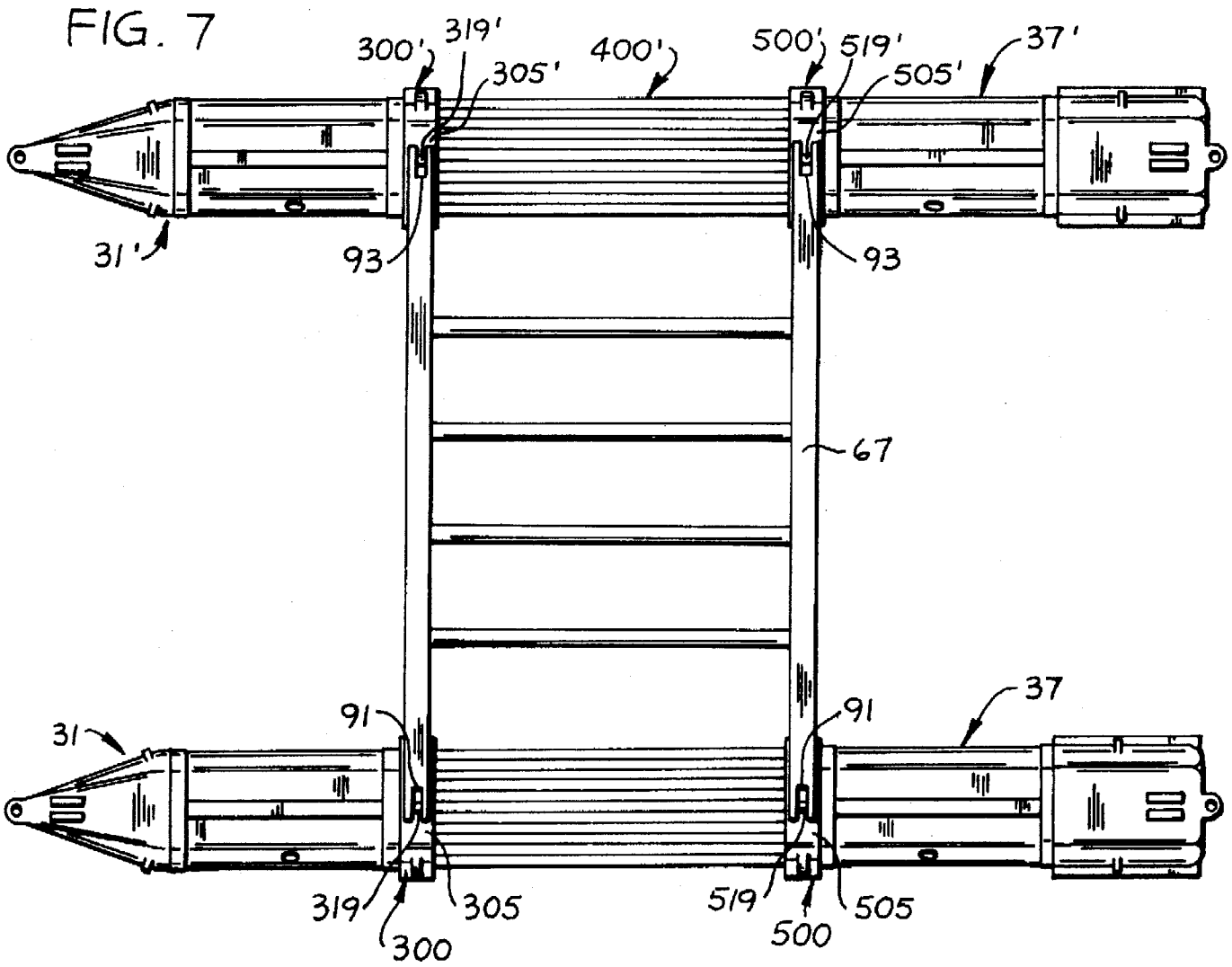
FIG. 7 is a top view of a pair of rescue pontoons of the invention connected by a ladder.

It is also contemplated that multiple pontoons may be used in combination to provide further rescue assistance. In particular, two or more pontoons may be connected together in side-by-side relationship to perform various rescue operations. FIG. 7 shows a pair of identical pontoons 31, 31' connected by a ladder 67 extending between the pontoons to form a catamaran configuration. The preferred ladder 67 shown in FIG. 7 is collapsible and is particularly sized and adapted to be operable with the rescue pontoon 31 of this invention. The ends 91, 93 of the ladder 67 rest on the load bearing sections 300, 500, 300', 500' of the shell 37, 37', and are fastened by fastening means to the attachment fittings 319, 519, 319', 519' extending upward from the top wall 305, 505, 305', 505' of the load bearing sections of the shell. Various fastening means are contemplated to be within the scope of this invention, such as straps, bolts, and other common means used in fastening. For ease of transport and storage, the ladder 67 is lightweight and collapsible so that it can be carried along with the folded rescue pontoon 31, such as in a bag (not shown). It is contemplated, however, that any standard ladder which is sufficiently narrow to rest on the load bearing sections 300, 500, 300', 500' or along the load distributing section 400, 400' may be used to connect the rescue pontoons 31 and remain within the scope of this invention. In the catamaran configuration, the pontoons 31 can be used to rescue a victim from hydraulics situations by towing the catamaran. As shown in FIG. 2, the grab lines 59, 61, for use in operational handling and victim rescue, are connected to encircle the pontoon 31 and consist of a brightly colored material for high visibility.

For use during an ice rescue, a series of pontoons 31 can be inflated and connected by ladders 67 in a manner similar to that shown in FIG. 7. The weight of the ladder 67 and rescuer(s) is distributed over the length of each pontoon 31 so that it will be less likely to break through ice, and if it does break through, the inflated pontoons will provide several hundred pounds of positive buoyancy to prevent the immersion of rescuers as they extricate victims.

With respect to a confined space rescue, the pontoons 31 may be used in a similar manner to distribute the weight of rescuers and equipment around a collapsed trench or other unstable confined space rescue incident.

With respect to victim transport, a stretcher or a backboard (not shown) may be suspended above the water between two pontoons 31 to facilitate removal of a victim from a distant water rescue sight to a medical treatment location.

In the event of a mass casualty water rescue involving a multipassenger conveyance such as a bus, train, passenger car or aircraft, numerous pontoons 31 could be deployed around the vehicle to provide floatation to victims as soon as they escape or are extricated from the vehicle.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An inflatable rescue pontoon for performing multiple water rescue operations, the rescue pontoon comprising an elongate shell having a central longitudinal axis when the pontoon is inflated and a plurality of interconnected sections aligned longitudinally along the central longitudinal axis, the plurality of sections including a bow section, a stern section and at least one folding section the bow section being the forwardmost section and constructed of a high-impact resistant material to prevent damage to the pontoon, the stern section being the rearwardmost section, the folding section being intermediate the bow and stern sections and constructed of a flexible, abrasion resistant material to prevent abrading of the shell, the abrasion resistant material being a different material than the high-impact resistant material of the bow section and being sufficiently limp when the pontoon is deflated so that the folding section is capable of folding over on itself for folding the rescue pontoon into a compact configuration for transport; and valve means communicating with said shell for selectively inflating and deflating the pontoon.

2. A rescue pontoon as set forth in claim 1 wherein the bow section is hydrodynamically shaded to enhance maneuverability of the pontoon in water.

3. A rescue pontoon as set forth in claim 1 wherein said stern section is constructed of a high-impact resistant material.

4. A rescue pontoon as set forth in claim 1 wherein said plurality of sections of the shell further includes a load distributing section located between the bow section and stern section, the load distributing section being made of a flexible, abrasion resistant material, the load distributing section having load distributing means for distributing loads applied to the load distributing section to other sections of the shell.

5. A rescue pontoon as set forth in claim 4 wherein said load distributing means comprises a plurality of longitudinally extending reinforcing rods.

6. A rescue pontoon as set forth in claim 5 wherein the load distributing section of the shell has a plurality of longitudinally extending pockets defined therein, the reinforcing rods each being received in a corresponding one of the pockets.

7. A rescue pontoon as set forth in claim 6 wherein said load distributing means is at least partially supported by sections of the pontoon shell adjacent to the load distributing section for transmitting a portion of any load carried by said load distributing means to said adjacent sections.

8. A rescue pontoon as set forth in claim 1 wherein the pontoon further comprises an inflatable, airtight bladder substantially fully enclosed within the shell, said valve means communicating with the inflatable bladder for selectively inflating and deflating the bladder.

9. A rescue pontoon as set forth in claim 8 wherein the inflatable airtight bladder is a first inflatable airtight bladder, the rescue pontoon further comprising a second inflatable bladder extending longitudinally within the shell in substantially parallel relationship with the first bladder, the first and second bladders being entirely independent of each other, there being no fluid communication between the first and second bladders.

10. A rescue pontoon as set forth in claim 9 wherein said valve means comprises a first one-way air inflation valve extending outwardly from of the first bladder through the shell and a second one-way air inflation valve extending outwardly from the second bladder through the shell, the first inflation valve being in fluid communication with the first bladder for inflating the first bladder and the second inflation valve being in fluid communication with the second bladder for inflating the second bladder.

11. A rescue pontoon as set forth in claim 10 further comprising an inflation connector adapted to simultaneously connect the first and second inflation valves to a single source of gas for inflating the bladders.

12. A rescue pontoon as set forth in claim 10 wherein said valve means further comprises a first pressure relief valve extending outwardly from the first bladder through the shell and a second pressure relief valve extending outwardly from the second bladder through the shell, the first and second pressure relief valves being separate and apart from the first and second air inflation valves, the first pressure relief valve being in fluid communication with the first bladder for deflating the first bladder, and the second pressure relief valve being in fluid communication with the second bladder for deflating the second bladder.

13. An inflatable rescue apparatus for performing multiple water rescue operations, the rescue apparatus comprising a rescue pontoon including an elongate shell having a plurality of sections, at least one of said sections being sufficiently flexible to allow folding of the pontoon, the shell further having first and second spaced apart load bearing members being substantially rigid, and load distributing means extending between said load bearing members said load distributing means being at least partially supported by said first and second load bearing members such that loads bearing on said load distributing means are distributed to the first and second load bearing members.

14. A rescue apparatus as set forth in claim 13 wherein said load distributing means comprises a plurality of longitudinally extending reinforcing rods.

15. A rescue apparatus as set forth in claim 14 wherein the load bearing members have a plurality of sockets therein, the reinforcing rods having opposing ends for seating within the sockets such that loads bearing on the load distributing means are distributed to the first and second load bearing members and loads bearing on the load bearing members are distributed to the load distributing means.

16. A rescue apparatus as set forth in claim 13 wherein the rescue pontoon is a first rescue pontoon, the apparatus further comprising a second rescue pontoon substantially identical to the first rescue pontoon, the first and second rescue pontoons being in spaced, substantially parallel relationship, a connector extending transversely between the first and second rescue pontoons, and means for attaching the connector to the first and second load bearing members of the first and second pontoons.

17. A rescue apparatus as set forth in claim 16 wherein the connector is a ladder having two substantially parallel frame members and one or more rungs extending between the frame members, the ladder having a first end and a second end, the frame members of the first end lying on the load bearing members of the first rescue pontoon and the frame members of the second end lying on the load bearing members of the second rescue pontoon, the frame members of the first and second ends of the ladder being attached to the first and second rescue pontoons respectively by said attaching means.

18. A rescue apparatus as set forth in claim 17 wherein said attaching means comprises an eyelet extending upward from each of the load bearing members, and fastening means for fastening each frame member of the ladder to a respective eyelet.

19. An inflatable rescue apparatus for performing multiple rescue operations, the apparatus comprising:

an elongate shell having a bow section, a forward folding section, a forward load bearing section, a central load distributing section, a rear load bearing section, a rear folding section and a stern section, each section being connected to an adjacent section, the sections being arranged in the following order from front to rear, the bow section, the forward folding section, the forward load bearing section, the central load distributing section, the rearward load bearing section, the rearward folding, section and the stern section;

the bow section, stern section and load bearing sections being made of a high-impact resistant material, the load distributing section and folding sections being made of a flexible, abrasion resistant material;

the folding sections being constructed for folding back upon themselves when the pontoon is deflated such that the bow section and the stern section are engageable with the central load distributing section in a compact configuration for transport of the apparatus;

an inflatable, airtight bladder substantially fully enclosed within the shell; and valve means communicating with the inflatable bladder for selectively inflating and deflating the bladder.

20. A rescue apparatus as claimed in claim 19, wherein the high-impact resistant material of the bow section, stern section and load bearing sections is flexible such that the rescue pontoon may be further compacted for transport.

21. An inflatable rescue pontoon for performing multiple water rescue operation, the rescue pontoon comprising:

an elongate shell having a plurality of sections including a bow section, a stern section and a load distributing section, the sections being longitudinally aligned when the pontoon is inflated, the bow section being the forwardmost section and made of a high-impact resistant material to prevent damage to the pontoon, the stern section being the rearwardmost section and being made of a high-impact resistant material, the high-impact resistant material of the bow section and stern section is flexible such that the bow and stern sections may be at least partially collapsed when the pontoon is deflated for transport, at least one of the pontoon sections intermediate the bow and stern sections being constructed for folding over on itself when the pontoon is deflated such that the rescue pontoon may be folded into a compact configuration for transport, the load distributing section being located between the bow section and stern section, the load distributing section being made of a flexible, abrasion resistant material, the load distributing section having load distributing means for distributing loads applied to the load distributing section to other sections of the shell; and valve means communicating with said shell for selectively inflating and deflating the pontoon.

22. A rescue pontoon as set forth in claim 21 wherein said load distributing means comprises a plurality of longitudinally extending reinforcing rods.

23. A rescue pontoon as set forth in claim 22 wherein the load distributing section of the shell has a plurality of longitudinally extending pockets defined therein, the reinforcing rods each being received in a corresponding one of the pockets.

24. A rescue pontoon as set forth in claim 21 wherein said load distributing means is at least partially supported by sections of the pontoon shell adjacent to the load distributing section for transmitting a portion of any load carried by said load distributing means to said adjacent sections.

* * * * *